US005131505A

United States Patent [19]

Isenmann

[11] Patent Number: 5,131,505

[45] Date of Patent: Jul. 21, 1992

[54] GUIDE RAIL SYSTEM FOR ELEVATORS

[75] Inventor: Walter Isenmann, Adligenswil, Switzerland

[73] Assignee: Inventio AG, Hergiswil, Switzerland

[21] Appl. No.: 707,565

[22] Filed: May 30, 1991

[30] Foreign Application Priority Data

May 30, 1990 [CH] Switzerland ..... 01 833/90

[51] Int. Cl.[5] ..... B66B 7/02

[52] U.S. Cl. ..... 187/95; 238/138

[58] Field of Search ..... 187/95, 1 R; 238/134, 238/135, 137, 138; 403/292, 309

[56] References Cited

U.S. PATENT DOCUMENTS 2,321,106 6/1943 Sanford ..... 189/35
4,637,496 1/1987 Atkey et al. ..... 187/95

FOREIGN PATENT DOCUMENTS 777242 6/1972 Belgium .
149773 7/1985 European Pat. Off. .
2014032 10/1970 Fed. Rep. of Germany .
3108050 8/1982 Fed. Rep. of Germany .
804743 11/1958 United Kingdom .
2174976 11/1986 United Kingdom .

*Primary Examiner*—Robert P. Olszewski
*Assistant Examiner*—Kenneth Noland
*Attorney, Agent, or Firm*—William J. Clemens

[57] ABSTRACT

Elevator guide rails are mounted in an elevator shaft by pivoting into a cutout formed in one of a plurality of fastening plates located in the shaft and securing with a wedge inserted into the cutout. The guide rails are connected together by a rectangular cross section plug which fits into a cooperating rectangular cross section inner area of the guide rail. The plug is partially inserted into the upper end of each guide rail and the next upper guide rail is lowered onto the plug extending from the next lower guide rail. The butt joint between the guide rails does not interfere with the fastening plates since the plug connection is outside the mechanical fastening area. This means that the butt joints and the fastening positions can be at the same height in the elevator shaft without disturbing each other thereby permitting free choice in the placing of both the fastening points and the butt joints.

17 Claims, 5 Drawing Sheets

GUIDE RAIL SYSTEM FOR ELEVATORS

BACKGROUND OF THE INVENTION

The present invention relates generally to elevators and, in particular, to a guide rail system for elevators.

In the typical known guide rail system for elevators, T-shaped profile steel guide rails are attached by clamping claws at fastening brackets installed in the elevator shaft. The guide rails are fastened together by flat profile straps positioned on the rear sides of the rails. This method is expensive due to the time required for assembly and alignment, and different guide rail systems were created in order to avoid the known disadvantages of this system.

Another form of a guide rail profile, shown in the U.S. Pat. No. 4,637,496, is omega-shaped in cross-section. At the butt joints, this profile, in place of a flat connecting strap, deploys a round profile connector of the same cross section as the clear width of the omega-shaped rail profile. The inserted round profile connector is firmly clamped in position by external tightening elements.

The European patent specification 0 149 773 describes a fastening device for guide rails of elevators which replaces the previously described clamping claws for the guide rails with a metal fastening plate having a dovetail-shaped cutout. After the introduction of the guide rail into this cutout, the metal fastening plate is angled with respect to the guide rail so that the dovetail walls engage and retain the foot part of the guide rail. The metal fastening plate is fastened in this position to a retaining bracket installed in the shaft.

The above-described methods and solutions still have disadvantages different from the disadvantages of the first described system. The attachment of the guide rails together requires many individual small fasteners and is intensive in labor. Furthermore, the coincidence of a butt joint and a fastening point must be avoided, which prevents the independent positioning of the fastening points.

SUMMARY OF THE INVENTION

The present invention concerns a guide rail system for elevators which does not display the disadvantages se forth above, is quick and simple to install, and permits the free positioning of the fastening points along the elevator shaft. The guide rail system includes guide rails having a foot portion and a guide portion, fastening plates positioned at vertical spacings on the shaft wall or in a shaft frame, and guide rail connections at the guide rail butt joints:

The guide rail system has a plurality of fastening means each having at least one cutout for the insertion and guidance of one of the guide rails, the cutout having a rear abutment edge for abutting an outer face of the foot portion of the guide rail and at least one wedge abutment edge spaced from the rear abutment edge a distance which is greater than a thickness of the foot portion of the guide rail. At least one wedge is associated with each cutout for insertion between an inner face of the foot portion of the guide rail and the wedge abutment edge whereby the foot portion of the guide rail is forced against the wedge abutment edge. At the butt joints, a plug having a generally rectangular body cooperates with each of the guide rails which have a body with a generally rectangular open inner area bounded by inner faces of said guide rail body for insertion of the plug into abutting ends of the rails.

The advantages achieved by the present invention are that neither screws nor additional small fasteners are needed for the mounting of the guide rails and that the choice of location of the fastening points is not influenced by the kind of rail connection to be made. The fastening of the guide rail is achieved through the mere pivoting into a fastening plate cutout with subsequent securing by a wedge member inserted in the cutout. The butt joint connection of the guide rails is through a plug mechanism which is internal to the rail profile and avoids any kind of interference with the mechanical fastening system. A further advantage is that a great amount of assembly time is saved through the omission of any kind of screw fastening during the mounting of the guide rails.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
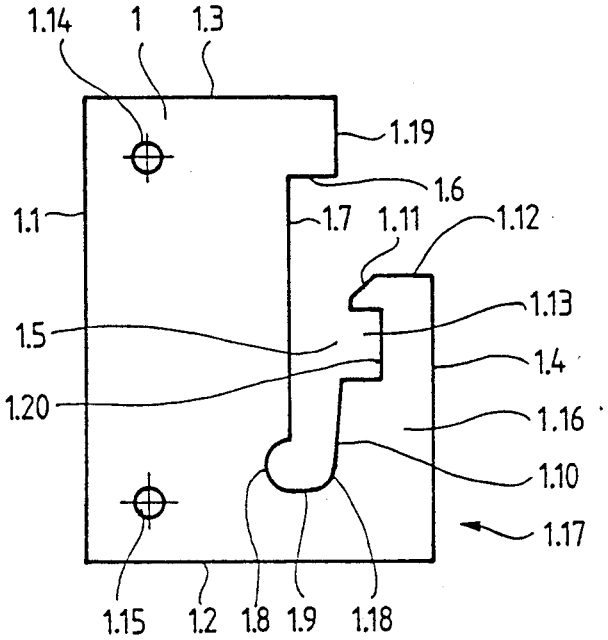
FIG. 1 is a plan view of a fastening plate with a cutout in accordance with the present invention utilized in the guide rail system shown in the FIG. 5.

There is shown in the FIG. 1 a fastening plate 1 with a rear longitudinal side 1.1, a generally parallel front longitudinal side 1.4, and a lower transverse side 1.2 and an upper transverse side 1.3 extending between the front and rear sides to forma generally rectangular planar body. A cutout 1.5 extends into the bodyu from the junction of the upper side 1.3 and the front side 1.4 and a pair of spaced apart fastening apertures 1.14 and 1.15 are formed through the body. A leg 1.16 is formed by the cutout 1.5, boundedf at the right by the longitudinal front side 1.4 and at the top by an end face 1.12 at the opening of the cutout 1.5. The leg 1.16 is further bounded by a 45° bevel 1.11 extending betwen the end face 1.12 and a rectangular wedge guide cutout 1.13 having a wedge abutment edge 1.20 extending generally parallel to the front side 1.4. Below the cutout 1.13, an edge 1.10 extend obliquely at about 10° into a transition rounding 1.18 and a lower abutment edge 1.9. Teh cutout 1.5 is further bounded by a rear abutment edge 1.7 which is connected by a half-round recess 1.8 at the lower end to the lower abutment edge 1.9. The rear abutment edge 1.7 is connected at an upper end to an upper abutment edge 1.6 extending to the right at right angles to the rear abutment edge 1.7. A vertical edge 1.19 extends from the upper abutment edge 1.6 to the upper transverse side 1.3 at the opening of the cutout 1.5. The fastening plate 1 has a thickness 1.17 (see the FIG. 8) of four millimeters, for example.

Figure 2:
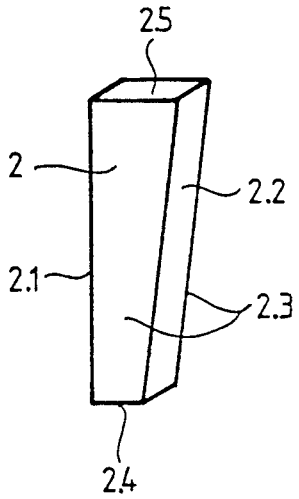
FIG. 2 is perspective view of a fastening wedge utilized in the system shown in the FIG. 5.

The FIG. 2 shows a wedge 2 with a pair of opposed vertical side surfaces 2.3, a front vertical surface 2.1, and a rear surface 2.2 inclined, for example, at 5° to the vertical. The body of the wedge 2 is completed by a lower end face 2.4 and an upper end face 2.5.

Figure 2A:
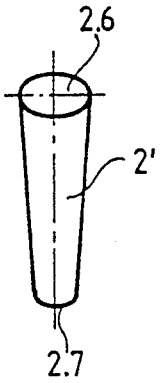
FIG. 2*a* is a perspective view of a conical pin utilized in an alternate embodiment guide rail system as shown in the FIG. 5*a*.

In the FIG. 2*a* there is shown a conical pin 2' with an upper thickner diameter 2.6 and a lower thinner diameter 2.7. The pin 2' is an alternate to the wedge 2 as will be discussed.

Figure 3:
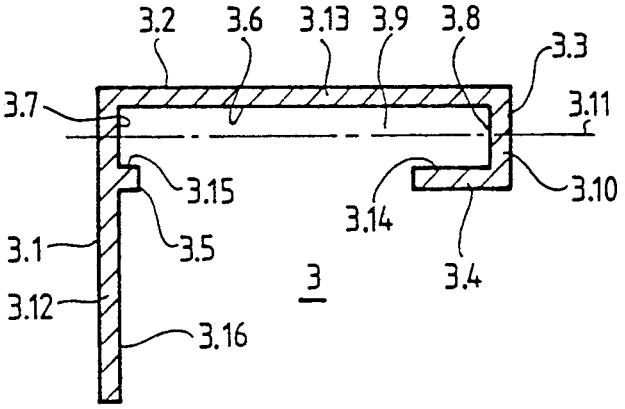
FIG. 3 is a cross-sectional plan view of a guide rail utilized with the system shown in the FIG. 5.

The FIG. 3 shows a guide rail 3. A foot portion 3.12 forms a right angle with a guide portion 3.13 extending generally parallel to a guide axis 3.11. A short leg member 3.10 and a short leg member 3.4 form a U-shaped end at the right-hand end of the guide portion 3.13. Inner sides or faces 3.8, 3.6 and 3.7 bound three sides of a rectangular area 3.9, while an inner face 3.14 of the leg 3.4 of the U-shaped end and an inner face 3.15 of a lip 3.5 extending from the foot 3.12 partially bound the fourth side of the rectangular area 3.9. An inner face 3.16 of the foot portion 3.12 below the lip 3.5 serves as wedge bearing surface. An outer surface of the guide rail 3 is defined by an outer face 3.1 of the foot portion 3.12, an outer face 3.2 of the guide portion 3.13 and an outer end face 3.3 of the short leg member 3.10 of the U-shaped end.

Figure 4:
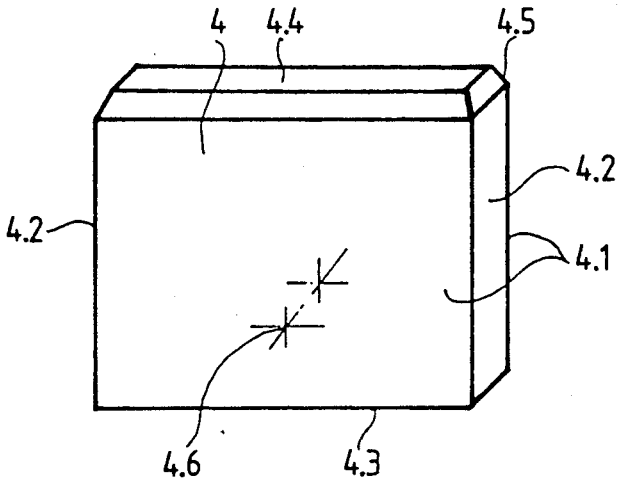
FIG. 4 is a perspective view of a plug utilized with the system shown in the FIG. 5.

The FIG. 4 shows a plug 4 in the shape of a rectangular flat body with a base or cross-sectional surface 4.3, generally parallel pair of opposed wide side surfaces 4.1 and a generally parallel pair of opposed narrow side surfaces 4.2. An encircling bevel 4.5 bounds an upper end face 4.4. A transverse bore 4.6 can be formed in the center of the lower portion of the sides 4.1 of the plug 4.

Figure 5:
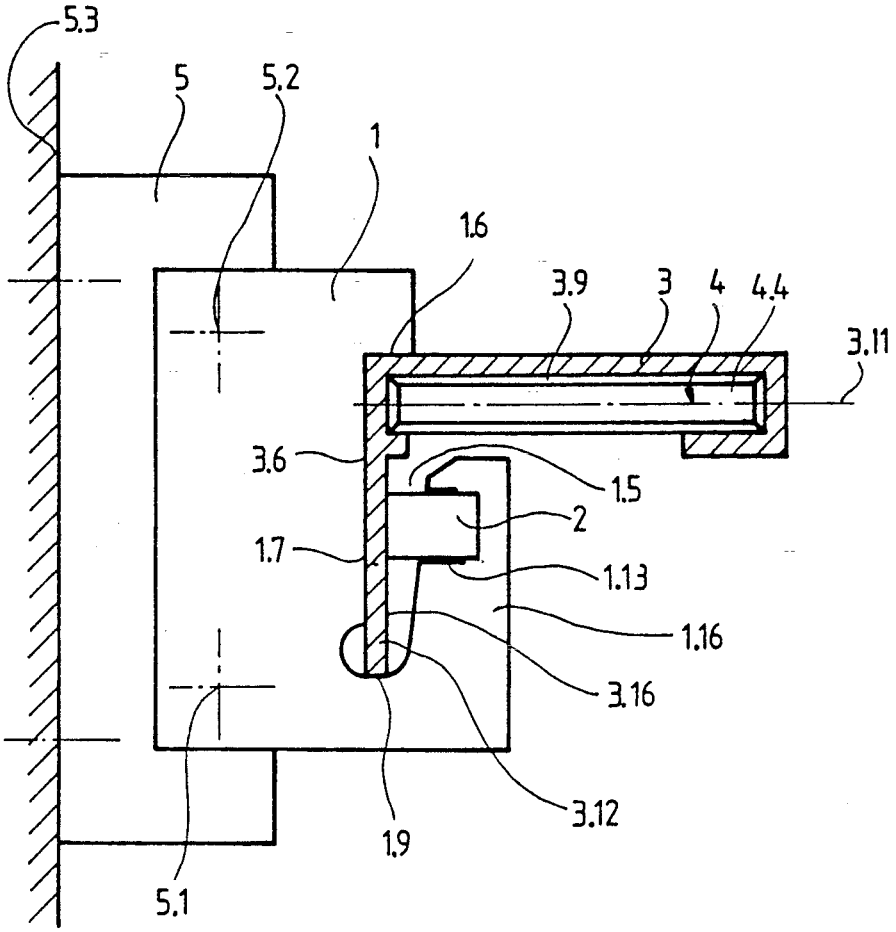
FIG. 5 is a cross-sectional plan view of an elevator guide rail system in accordance with the prsent invention.

The FIG. 5 shows in cross section a guide rail system assembled from the elements described above. The fastening plate 1 is attached by two screws 5.1 and 5.2 to a carrier 5 which is constructed as an angle in profile and mounted, for example, on an elevator shaft wall 5.3. The guide rail 3 is inserted into the cutout 1.5 of the fastening plate 1 with the outer face 3.6 of the foot portion 3.12 flush against the rear abutment edge 1.7 and is guided laterally by the lower abutment edge 1.9 and by the upper abutment edge 1.6. The wedge 2 is inserted into the wedge guide cutout 1.13 and holds the guide rail 3 firmly in the position shown. Furthermore, there is shown the next lower guide rail connection wherein the plug 4, or its upper end face 4.4, is visible and is inserted into the rectangular inner area 3.9 of the guide rail 3. The plug 4, which is preferably inserted to one half of its length at the upper end of a guide rail 3 and fixed, for example, by a screw or rivet connection through the aperture 4.6, permits the rotationally stiff and aligned adding-on of the next following upper guide rail 3, which in turn has a plug 4 inserted at its upper end. The adding-on of the next following guide rail 3 is facilitated by the bevel 4.5 at the upper end of the plug 4 extending from the upper end of the currently uppermost guide rail.

Figure 5A:
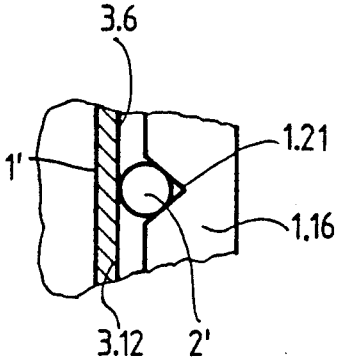
FIG. 5*a* is a fragmentary cross-sectional plan view of an alternate embodiment elevator guide rail system.

The FIG. 5*a* shows an alternate embodiment of the guide rail system with fastening by the conical pin 2' shown in the FIG. 2*a*. The pin 2' is inserted between the inner face 3.6 of the foot portion 3.12 of the guide rail and a notch 1.21 formed in the leg 1.16 of an alternate embodiment fastening plate 1'.

Figure 6:
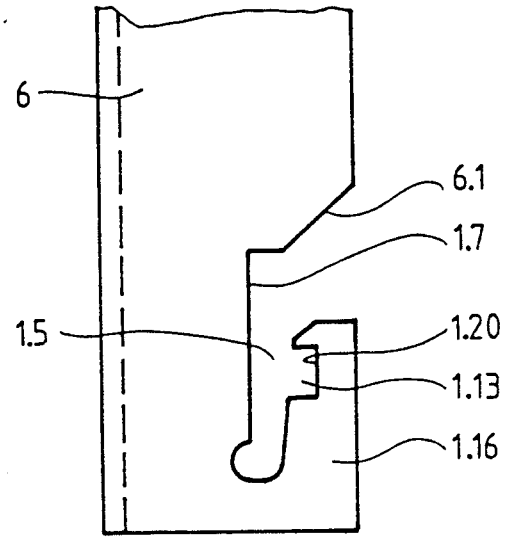

In the FIG. 6 there is shown the cutout 1.5 formed in an alternate embodiment carrier 6 having a right angle cross section. The difference from the fastening plate 1 shown in the FIG. 1 is that, by reason of a greater upper width of the carrier 6, a 45° bevel 6.1 can be formed facilitating the introduction of the guide rail 3 into the cutout 1.5. The carrier 6 can be formed from an L-shaped iron beam.

Figure 7:
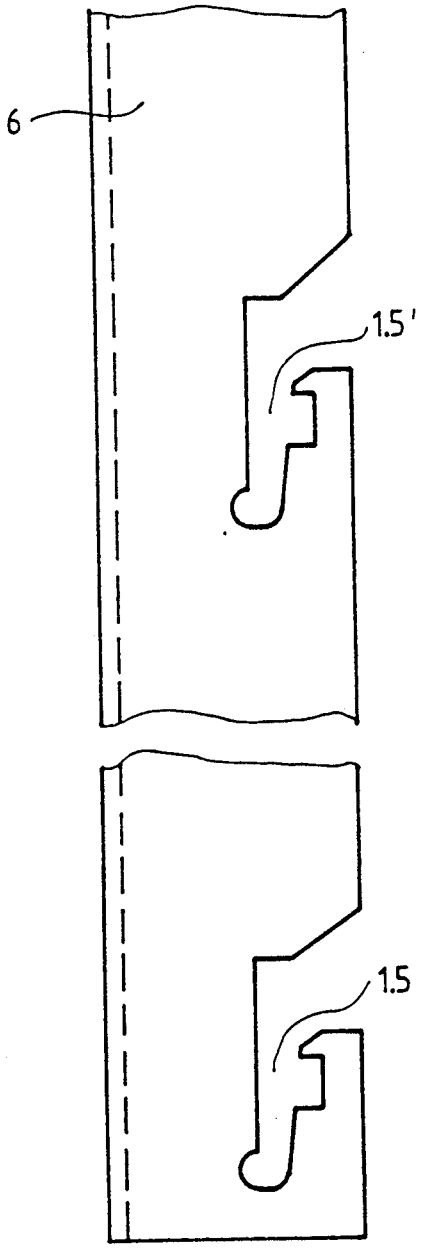
FIG. 7 is a plan view of the carrier shown in the FIG. 6 with two cutouts.

The FIG. 7 shows that two cutouts can, for example, be formed in the carrier 6 wherein a first cutout 1.5 can serve for the car guides and a second cutout 1.5' can serve for the counterweight guides. The cutouts 1.5 and 1.5' can also be formed in the fastening plate 1 if the plate is extended.

Figure 8:
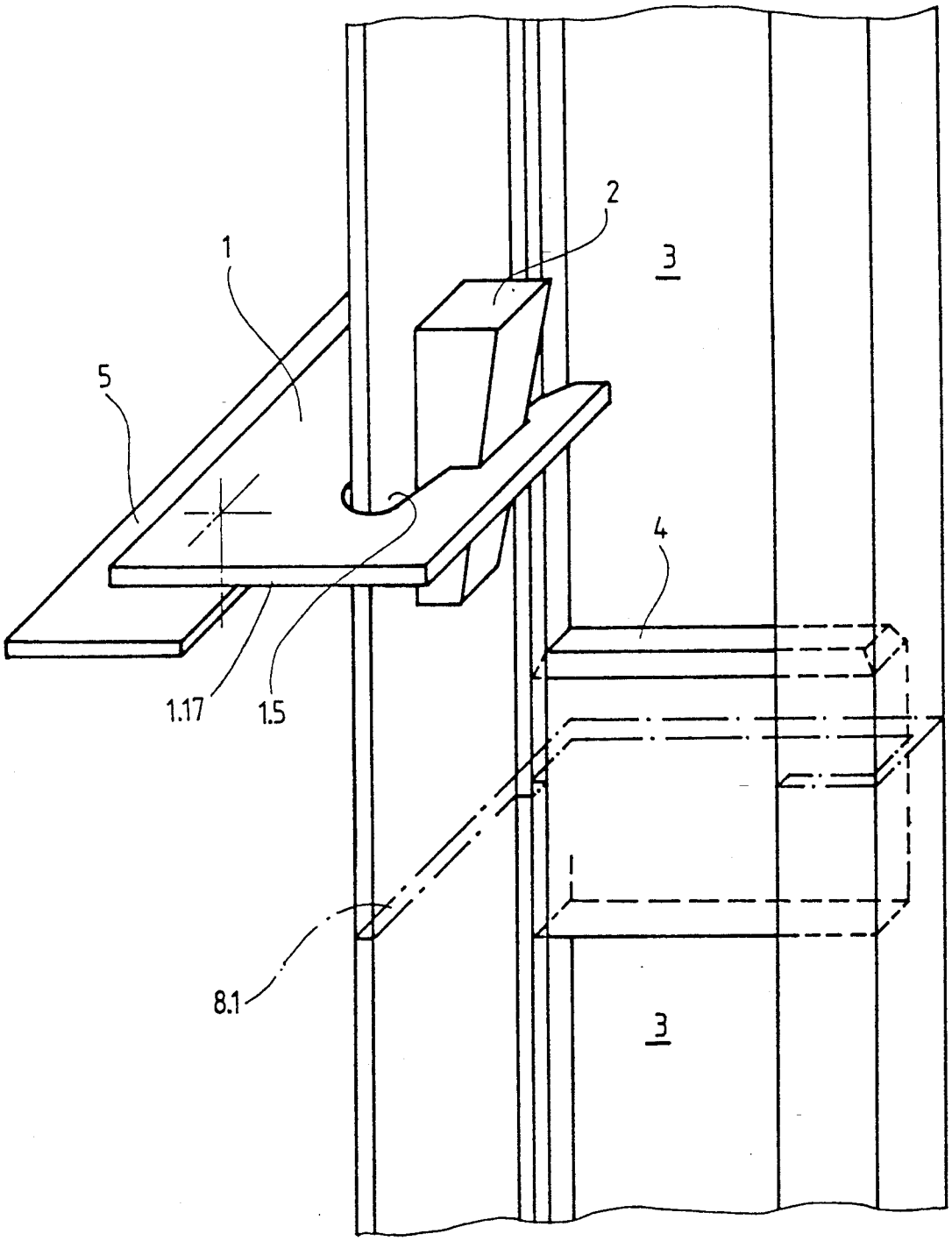
FIG. 8 is a perspective view of the elevator guide rail system shown in the FIg. 5.

The FIG. 8 shows an overall perspective view of the complete fastening and connection of the guide rail system shown in the FIG. 5. A butt joint 8.1 for the guide rails 3 is situated below the fastening plate 1 for the purpose of greater clarity in the illustration. However, the joint could also be at exactly the same height as the fastening point because the plug connection with the plug 4 does not interfere with either the fastening plate 1 or the wedge 2.

Figure 9:
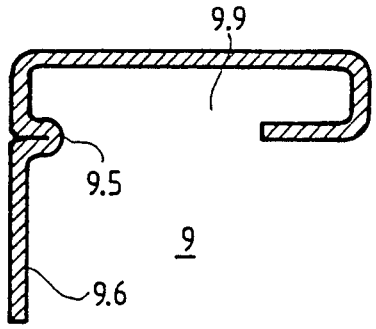
FIG. 9 is a cross-sectional plan view of an alternate embodiment guide rail.

The FIG. 9 shows an alternate embodiment guide rail 9 which is manufactured, in a folding technique for example, from steel plate. The guide rail 9 can have exactly the same geometric dimensions at the contact points as the system using the guide rail 3 shown in the FIG. 3 and, thus, can be used as a replacement for the guide rail 3. A rectangular inner area 9.9 of the rail 9 corresponds to the rectangular inner area 3.9 of the rail 3. A flat side rectangular shape with rounded longitudinal edges is used for retaining the plug 4 because the corners can not be made sharp edged due to the fabrication method. A lip 9.5 extends from an inner face 9.6 of the foot portion of the rail 9 and functions in the same manner as the lip 3.5 on the rail 3.

Figure 10:
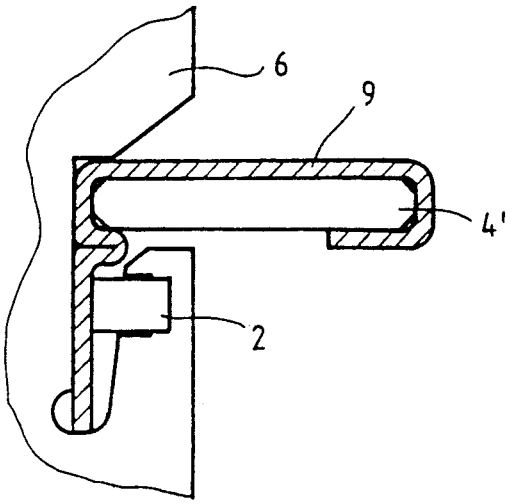
FIG. 10 is a cross-sectional plan view of a second alternate embodiment elevator guide rail system utilizing the carrier shown in the FIG. 6 and the guide rail shown in the FIG. 9.

The FIG. 10 shows the guide rail 9 installed in a second alternate embodiment guide rail system which is no different from the fastening technique utilized in the guide rail system shown in the FIG. 5. A plug 4' has beveled edges to accommodate the rounded longitudinal edges of the inner area 9.9 of the guide rail 9.

Figure 11:
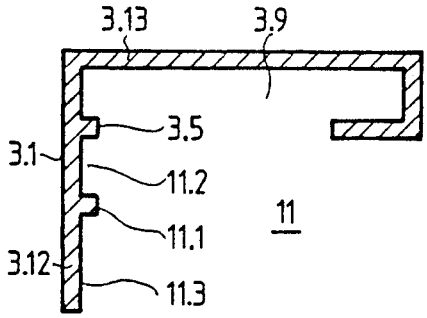
FIG. 11 is a cross-sectional plan view of a second alternate embodiment guide rail including a wedge guide.

The FIG. 11 shows a second alternate embodiment guide rail 11 which is constructed identical to the guide rail 3, but has an additional lip 11.1 formed on an inner face 11.3 of the foot portion 3.12. The additional lip 11.1 is so positioned that a wedge guide groove 11.2 for the reception of the wedge 2 is formed on the inner face 11.3 of the foot portion of the guide rail 11 between the lip 11.1 and the lip 3.5.

Figure 12:
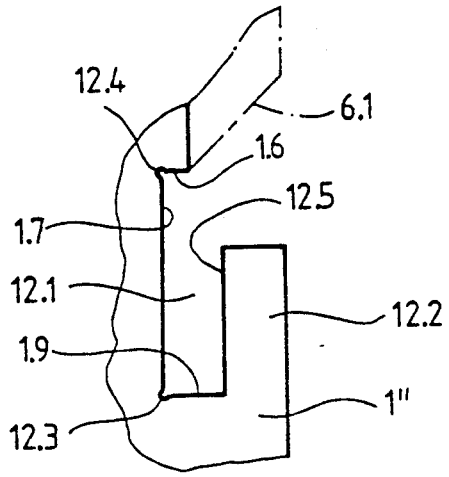
FIG. 12 is a fragmentary plan view of a second alternate embodiment fastening plate.

In the FIG. 12 there is shown a cutout 12.1 which accommodates the guide rail 11 and can be formed in a second alternate embodiment fastening plate 1'' as well as in the carrier 6. The rear abutment edge 1.7, the lower abutment edge 1.9 and the upper abutment edge 1.6 are present as in the plate 1 shown in the FIG. 1. A pair of recesses 12.3 and 12.4 formed at the corners of the cutout 12.1 effect a guaranteed resting of the outer surfaces of the guide rail 11 against the abutment edges 1.6, 1.7 and 1.9. A vertical, generally rectangular leg 12.2 does not have the wedge guide cutout 1.13 formed therein which is no longer necessary with the wedge guide groove 11.2 formed in the guide rail 11.

Figure 13:
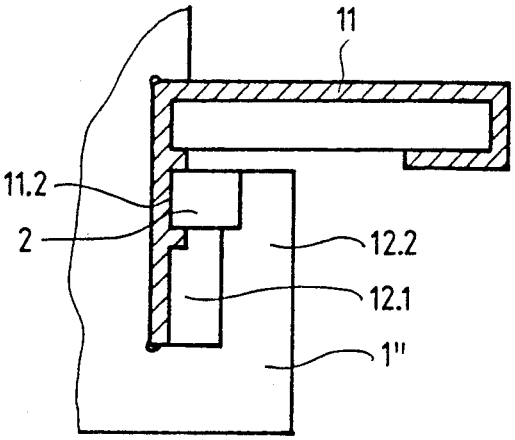
FIG. 13 is a cross-sectional plan view of a third alternate embodiment elevator guide rail system utilizing the fastening plate shown in the FIG. 12 and the guide rail shown in the FIG. 11.

The FIG. 13 shows the guide rail 11 installed in the fasteninq plate 1' with the cutout 12.1 to form a third alternate embodiment guide rail system. The fastening principle is the same as already illustrated in the FIGS. 5, 5*a*, 8 and 10. Since the wedge guide groove 11.2 in the guide rail 11 has the same geometric dimensions as the wedge guide cutout 1.13 in the case of the leg 1.16 of the cutout 1.5, the same wedge 2 can be used in this system.

Figure 14:
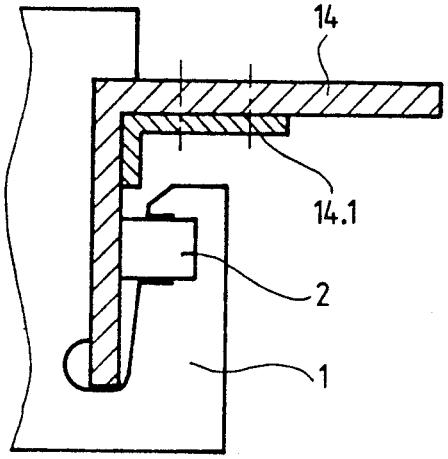
FIG. 14 is a cross-sectional plan view of a fourth alternate embodiment elevator guide rail system utilizing the fastening plate shown in the FIG. 1 and a third alternate embodiment guide rail.

The FIG. 14 shows a variant of the principle of fastening according to the present invention with the use of a drawn right angle profile guide rail 14 in a fourth alternate embodiment quide rail system. The longitudinal connection of the rails 14 one to the other can be accomplished through fastening the abutting ends of the rails together with a smaller angle profile bracket 14.1 lying inside the guide rail 14.

The aforedescribed equipment operates as follows: At the beqinninq of the assembly for the installation of the quide rail in a elevator installation, either the carriers 5 or the carriers 6 are mounted first. The carrier plates 1 are then screwed to the carriers 5 and oriented with respect to perpendicularity, guide axis and spacings. When the carriers 6 are used, these are components of a shaft construction which is not more fully described here, but in itself is known and is constructed, for example, as circumferential reinforcement in the elevator shaft. By dimensionally accurate prefabrication and installation, the cutouts 1.5 present in the carriers 6 are in the correct position, do not need to be aligned and thus are ready for the reception of the guide rails.

A first guide rail 3 preferably has a length which is greater than the vertical spacing between two cutouts 1.5 in vertically adjacent ones of the carriers. The rail is pivoted, starting from below, into these first two cutouts and is fixed in the pivoted-in position by a pair of the wedges 2. The lower end of the first guide rail 3 is supported at the shaft bottom. The wedges 2 need only be inserted by hand and not be hammered in. Due to their own weight, the wedges remain in the inserted position, hold the guide rail 3 firmly and also enable a vertical sliding of the guide rail 3 in its fastening, for example, in the case of shrinkage of the building due to aging.

The next following guide rail 3 is now inserted into the next upper cutout 1.5, pushed downwardly and plugged with a slight jerk onto the upper end of the first lower guide rail 3. The plug 4, which is installed in the upper end of the lower guide rail 3, makes a rotationally stiff and exactly aligned connection with the lower end of the upper guide rail 3. The butt connection is situated at a place in the interior of the guide rail 3 where no interference is possible with the mechanical fastening system. The immense advantage which results from this system is that a butt joint can lie exactly at the height of a fastening point without disturbing the fastening itself in any manner. This means also that the positioning of the fastening points, where the carriers are attached to the shaft walls, can be done completely independently of the rail guide lengths. The plug 4 and the rectangular area 3.9 are so dimensioned that the plug 4 can be introduced with a sliding fit free of play into the end of the guide rail 3. If the cutout 1.5 is formed in the carrier 6, the 45. bevel 6.1 extending to the edge of the carrier width is provides sufficient space for the pivoting-in of the guide rail 3. As shown in the FIG. 7, more than one cutout can be made in the carrier 6 to provide one for the counterweight guides.

The guide rail 3 can be formed with a right angle profile from drawn stell or an extruded light metal. A further possibility is manufacturing the guide rail 3 from sheet metal with a folding technique as the FIG. 9 shows. In that case, everything remains exactly the same in principle with the small exception that the corners of the rectangular internal area 9.9, by comparison with that area denoted by 3.9 in the FIG. 3, are not equally sharp edged due to the folding technique. Such a rail with broken or rounded longitudinal edges requires the use of the plug 4' shown in the FIG. 10.

A simplified cut-out 12.1 in a developed form is illustrated in the FIG. 12. Due to the omission of the wedge guide cutout 1.13, the cutout 12.1 can be manufactured by simpler means. The recesses 12.3 and 12.4 can be omitted in the case of sufficiently sharp corners. They should, in case of doubt, be utilized to guarantee a resting of the outer surfaces of the guide rail 11 against the abutment faces 1.6, 1.7 and 1.9. If this simplified cutout is made in the carrier 6, then it is likewise to be augmented by the 45. bevel 6.1. The guidance of the wedge 2 is taken over by the guide rail 11. In order to take over this function, the guide rail 11 has the second lip 11.1 which is formed at an appropriate distance from the lip 3.5 on the same inner face 11.3 of the foot 3.12 and forms the wedge guide groove 11.2. It is clearly evident from the FIG. 13 that this wedge guide groove 11.2 fulfills exactly the same function as the wedge guide cutout 1.13 in the fastening plate 1. It is also possible that in place of the wedge 2 a conical 2' can be used for the same purpose, wherein a cornered or half-round notch 1.21 is provided in the leg 1.16 for its guidance.

With a somewhat wider wedge 2, it is possible to fix the guide rail quite securely without a guide rail wedge guide groove or a wedge guide cutout in the cutout 1.5.

All of the guide rails described above have a construction on the guide side which is intended for the use of elevator car guide rollers such as simple guide rollers with projecting side rims or for classical triaxial guide rollers. Half-round constructions of the right-hand guide ends are also possible on which guide rollers then run with half-round grooves. A drawn right angle iron profile can be used as the guide rail profile 14 for simple sliding guides, for example, in the case of elevators for small goods as shown in the FIg. 14. In order that the advantages of the system can be exploited further, the strap connection is undertaken by means of the angle brackets 14.1 lying inside the guide rail 14.

To that extent, no limits are set on the principle of application of the present invention, since heavy guide rails also can be fastened and connected in the described manner through appropriate construction of the foot portions and the guide portions of the profile. The princple of the invention also offers advantages on its use for temporary installations, such as, for example, building site elevators and the like, because a rational disassembly is just as important there as the assembly. The dimensioning of the shapes of the cutouts, fastening plates and guide rails can be adapted to the required purpose and to the forces to be withstood. Applications for all kinds of elevators can therefore be realized. On the use of the principle of the invention for passenger elevators and for goods elevators with accompanying persons, all components belonging to the system are adapted to the required rigidity and safety. Thus, the forces released by a car arresting device must be capable, in a known manner, of being absorbed on the stopping of a car without a permanent deformation arising in the rail guide system. The rail guide profile would then be constructed so that there is no hollow space in the region of the stopping and guide zone which is accomplished by an appropriate local redisposition of the plug internally of the rail profile.

The recessed rounding 1.8 and the recesses 12.3 and 12.4 can be omitted when the corresponding corners of the guide rails 3, 9 and 11 are not constructed to be sharp edged and the remaining geometry of the cutout 1.5 takes into account the somewhat greater width required thereby for the insertion of the guide rails 3, 9, and II.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A guide rail system for elevators having guide rails with a foot portion and a guide portion, fastening means positioned at vertical spacings in the elevator shaft for retaining the guide rails, and guide rail connections at butt joints of the guide rails comprising: a plurality of fastenign means each having at least one cutout for the insertion and guidance of a guide rail, said cutout having a rear abutment edge for abutting an outer face of a foot portion of the guide rail and at least one wedge abutment edge spaced from said rear abutment edge a distance which is greater than a thickness of the foot portion of the guide rail, and at least one wedge associated with each said cutout for insertion between an inner face of the foot portion of the guide rail and said wedge abutment edge whereby the foot portion of the guide rail is forced against said rear abutment edge and said wedge is forced against said wedge abutment edge.

2. The guide rail system for elevators according to claim 1 including at least two guide rails and wherien at least one butt joint connection is formed between abutting ones of said guide rails at the same position as one of said fastening means.

3. The guide rail system for elevators according to claim 2 whrein each said guide rail has a body with a generally rectangular open inner area bounded by inner faces of said body and said rectangular inner area cooperates with a plug inserted into one end of said guide rail.

4. The guide rail system for elevators according to claim 1 wherein each said fastening means includes a fastening plate attached to a carrier and said cutout is formed with an upper abutment edge, an opposed lower abutment edge and at least one recessed rounding.

5. The guide rail system for elevators according to claim 4 wherein said cutout is formed in said fastening plate.

6. The guide rail system for elevators according to claim 1 wherein each said fastening means includes a carrier and said cutout is formed in said carrier.

7. The guide rail system for elevators according to claim 6 wherein said cutout has an upper abutment edge and a bevel extending from said upper abutment edge to an edge of said carrier.

8. The guide rail system according to claim 1 wherein said fastening means has a leg with a wedge guide cutout forming said wedge abutment edge.

9. The guide rail system for elevators according to claim 8 including a guide rail wherein said guide rail has a wedge guide groove formed by a first lip and a spaced second lip extending generally parallel from an inner wall of said guide rail.

10. The guide rail system for elevators according to claim 8 wherein said wedge guide cutout is formed as a notch and said wedge is a conical pin.

11. The guide rail system for elevators according to claim 1 Including at least two guide rails and wherein each said guide rail has a body with a generally rectangular open inner area bounded by inner faces of said body and said rectangular inner area cooperates with a plug inserted into one end of said guide rail.

12. The guide rail system for elevators according to claim 1 including a guide rail wherein said guide rail has a wedge guide groove formed by a first lip and a spaced second lip extending generally parallel from an inner wall of said guide rail.

13. The guide rail system for elevators according to claim 1 wherein said fastening means has a leg with a wedge guide cutout forming said wedge abutment edge and said wedge guide cutout is formed as a notch and said wedge is a conical pin.

14. A guide rail system for elevators having guide rails with a foot portion and a guide portion, fastening means positioned at vertical spacings in the elevator shaft for retaining the guide rails, and guide rail connections at butt joints of the guide rails comprising:

a guide rail having a foot portion and a guide portion;

at least two fastening means each having at least one cutout for the insertion and guidance of said guide rail, said cutout having a rear abutment edge for abutting an outer face of said foot portion of said guide rail and at least one wedge abutment edge spaced from said rear abutment edge a distance which is greater than a thickness of said foot portion of said guide rail; and at least one wedge associated with each said cutout for insertion between an inner face of said foot portion of said guider ail and said wedge abutment edge whereby said foot portion of said guide rail is forced against said rear abutment edge and said wedge is forced against said wedge abutment edge.

15. The guide rail system for elevators according to claim 14 including at least two guide rails and wherein at least one butt joint connection is formed between abutting ones of said guide rails at the same position as one of said fastening means.

16. A guide rail system for elevators having guide rails with a foot portion and a guide portion, fastening means positioned at vertical spacings in the elevator shaft for retaining the guide rails, and guide rail connections at butt joints of the guide rails comprising:

at least a pair of guide rails each having a foot portion and a guide portion;

a plurality of fastenign means each having at least one cutout for the insertion and guidance of oen of said guide rails, said cutout having a rear abutment edge for abutting an outer face of said foot portion of said guide rail and at least one wedge abutment edge spaced from said rear abutment edge a distance which is greater than a thickness of said foot portion of said guide rail;

at least one wedge associated with each said cutout for insertion between an inner face of said foot portion of said guide rail and said wedge abutment edge whereby said foot portion of said guide rail is forced against said rear abutment edge and said wedge is forced against said wedge abutment edge; and a plug having a generally rectangular body, each said guide rail having a body with a generally rectangular open inner area bounded by inner faces of said guide rail body and said rectangular inner areas cooperate with said plug inserted into abutting ends of said guide rails.

17. The guide rail system for elevators according to claim 16 wherein said abutting ends form a but joint connection at the same position as one of said fastening means.

* * * * *